US005435027A

United States Patent [19]

Bourgraf et al.

[11] Patent Number: 5,435,027

[45] Date of Patent: Jul. 25, 1995

[54] ROLL-IN COT WITH HIGH GROUND CLEARANCE

[75] Inventors: Elroy E. Bourgraf, Cincinnati; Kenneth R. Berta, Lebanon; Jerry L. Taylor, Greenfield; Irvin D. Pollock, Wilmington, all of Ohio

[73] Assignee: Ferno-Washington, Inc., Wilmington, Ohio

[21] Appl. No.: 105,331

[22] Filed: Aug. 9, 1993

[51] Int. Cl.[6] ..... A61G 7/00; A61G 1/02

[52] U.S. Cl. ..... 5/611; 5/618; 5/86.1; 296/20

[58] Field of Search ..... 296/20; 5/611, 614, 5/618, 81.1, 86.1

[56] References Cited

U.S. PATENT DOCUMENTS

| | | | |
|---|---|---|---|
| 2,819,475 | 1/1958 | Ericsson | 5/617 |
| 2,833,587 | 5/1958 | Saunders | 5/611 |
| 3,644,944 | 2/1972 | Bourgraf | 296/20 |
| 3,826,528 | 7/1974 | East | 296/20 |
| 4,078,269 | 3/1978 | Weipert | 5/611 |
| 4,097,941 | 7/1978 | Merkel | 296/20 |
| 4,192,541 | 3/1980 | Ferneau | 296/20 |
| 4,222,131 | 9/1980 | Holdt | 5/617 |
| 4,767,148 | 8/1988 | Ferneau et al. . | |

FOREIGN PATENT DOCUMENTS

| | | | |
|---|---|---|---|
| 1541343 | 2/1970 | Germany | 5/611 |
| 3711048 | 10/1988 | Germany | 296/20 |
| 616325 | 3/1980 | Switzerland | 5/617 |

*Primary Examiner*—Flemming Saether

*Attorney, Agent, or Firm*—Killworth, Gottman, Hagan & Schaeff

[57] ABSTRACT

A roll-in cot is provided and includes a rectangular undercarriage including a pair of side frame members and a pair of transverse frame members, downwardly extending supports affixed at respective corners of the rectangular undercarriage, and undercarriage wheels attached to the downwardly extending supports to provide high ground clearance for the undercarriage. The cot also includes a cot frame having a pair of opposing side frame members and a pair of supports extending downwardly from each of the opposing side frame members. The opposite ends of the supports are secured to a transverse member having a pair of load wheels thereon. Coacting pairs of complementary cross-forming frame members extend between and interconnect the cot frame and the undercarriage.

19 Claims, 8 Drawing Sheets

ROLL-IN COT WITH HIGH GROUND CLEARANCE

BACKGROUND OF THE INVENTION

This invention relates to ambulance cots, and more particularly to a multi-level roll-in cot with high ground clearance and additional patient comfort features which may be used in different types of emergency vehicles having receiving floors of differing heights and wheel wells of differing clearances.

Conventional ambulance cots are provided with wheels to enable easy movement from one location to another, including rolling the cot into and out of an emergency vehicle such as an ambulance, van, station wagon, or modified truck. In their simplest forms, such cots have nonextensible wheels mounted beneath the cot frame.

More sophisticated types of ambulance cots also exist. Elevating cots are available in which the cot frame is mounted on legs which are designed to collapse as the cot is placed in the vehicle. Cots of this type may have two positions of use, or may have multiple adjustable positions. That is, such cots have a first "down" position in which the legs are fully collapsed and an elevated "up" position in which the cot is at a standard predetermined height for transferring the patient to a bed. Cots having adjustable positioning features may be positioned at a number of intermediate heights between the fully down and up positions.

However, cots of this type must be fully collapsed before being placed in the vehicle, which requires that the emergency medical attendants to bear the full weight of the patient while the undercarriage of the cot is being collapsed. To overcome this problem, ambulance cots have been designed with an extra set of retractable loading wheels which project forwardly of one end of the cot frame. In this manner, the cot may be wheeled to the vehicle in an up or elevated position and the loading wheels placed onto the floor of the vehicle. With one end of the cot supported by the vehicle floor, the undercarriage of the cot may then be collapsed as the remainder of the cot is rolled into the vehicle.

Roll-in ambulance cots have also been designed to accommodate emergency vehicles of differing types having different floor heights. For example, Ferneau et al, U.S. Pat. No. 4,767,148, teach a multiple level roll-in cot in which the leading end may be inclined upwardly even when in its elevated position to accommodate vehicles having unusually high floor levels. The cot also has back and foot position adjustable features.

However, the need still exists for roll-in ambulance cots which are even more versatile in their design and which possess a combination of features which permit their use in a wide variety of emergency vehicles while providing additional patient comfort features.

SUMMARY OF THE INVENTION

The present invention meets those needs by providing a roll-in ambulance cot which has a high ground clearance to accommodate the high wheel wells which may be found in some ambulances. The roll-in cot also has a pair of load bearing load wheels which are designed to be in contact with the floor of the ambulance when the cot is in a "down" position and bears at least a portion of the weight of a patient on the cot. Such a feature is desirable in those instances when an ambulance is transporting several patients or technicians who require upright seating in the back of the ambulance.

The cot further provides a latching pin and slot mechanism which provides a positive locking of the cot in a desired position. The cot also includes additional patient comfort and health features such as an assist feature for raising the back rest and a contour feature to provide a dual position foot rest.

In accordance with one aspect of the invention, a roll-in cot is provided having a rectangular undercarriage including a pair of side frame members and a pair of transverse frame members, the undercarriage having a leading end and a trailing end. Affixed at respective corners of the rectangular undercarriage are downwardly extending supports. Undercarriage wheels are attached to the downwardly extending supports to provide high ground clearance for the undercarriage enabling it to be wheeled into ambulances having a wide variety of floor designs, especially those vehicles having high wheel wells along the floor thereof.

The roll-in cot also includes a cot frame having a leading end, a trailing end, and a pair of opposing side frame members. The leading end includes a pair of supports extending downwardly from each of the opposing side frame members, with the opposite ends of the supports being secured to a transverse member. A pair of load wheels are secured to the cot frame through the transverse member. The load wheels are used when the cot is loaded into an ambulance, and the load wheels remain in contact with the floor of the vehicle when the cot is in a fully collapsed position.

The cot further includes coacting pairs of complementary cross-forming frame members which extend between and interconnect the cot frame and the undercarriage. The frame members in each pair are pivotally connected together intermediate their opposite ends and are operative to position the roll-in cot in at least a first "down" position in which the frame members are fully collapsed and the undercarriage wheels and the pair of load wheels support the weight of the roll-in cot and a second "up" position in which the frame members and the cot frame are elevated.

Other features of the roll-in cot include means for latching the frame members in the at least first down and second up positions, and preferably into multiple positions. In a preferred embodiment, the latching means comprise a pair of latching bars, with each of the latching bars secured at respective first ends thereof to the transverse member on the cot frame and at respective second ends thereof to a cross piece. Each of the latching bars includes a plurality of spaced apart slots therein, and the slots are adapted to engage a corresponding pair of load-bearing pins located on the transverse support member. The pin engaging means is operatively connected to the cross piece connecting the latching bars for engaging the pins in selected slots on the latching bars and is spring biased to force the pins into the slots. Because of the angle of the slots and the fact that the pins are load bearing, the latching mechanism provides a secure lock in whatever position is desired.

The cot frame also preferably includes longitudinally extending foot, seat, and back support sections. The back support section includes a gas-assisted cylinder for raising the back support section from a first substantially horizontal position to a plurality of raised positions. Means are also provided for locking the gas-assisted cylinder in position as well as releasing it for movement. The release mechanism includes a movable bar which cooperates with a depressible detent. Movement of the bar in any direction depresses the detent and releases the locking means. The back support section also preferably includes a tubular frame and support plate, with one end of the cylinder secured to the tubular frame via a swivel mounting and the opposite end of the cylinder hingedly mounted on the cot frame.

The foot support section includes first and second portions which are pivotally connected. The foot support section also preferably includes a latch member which is operative to raise the first and second portions to an elevated position or to slide the first portion relative to the second portion to form an inverted-V position.

The roll-in cot of the present invention is adaptable to a wide variety of ambulance designs and is particularly adapted for use in high ground clearance situations such as when the ambulance has high wheel wells in the floor thereof. The load bearing loading wheels provide a novel support system for the cot in which a number of patients may be seated on the cot as they are transported in the back of an ambulance. The roll-in cot of the present invention also includes a unique latching mechanism in which a load bearing pin and slot mechanism provides a secure lock-up for the cot. A gas-assisted back support and dual position foot rest makes it simple for an ambulance emergency technician to place a patient in the most comfortable or appropriate position for transport. These and other features of the present invention will become clear from the following detailed description, the accompanying drawings, and the appended claims.

DETAILED DESCRIPTION OF THE PREFERRED EMBODIMENTS

Figure 1:
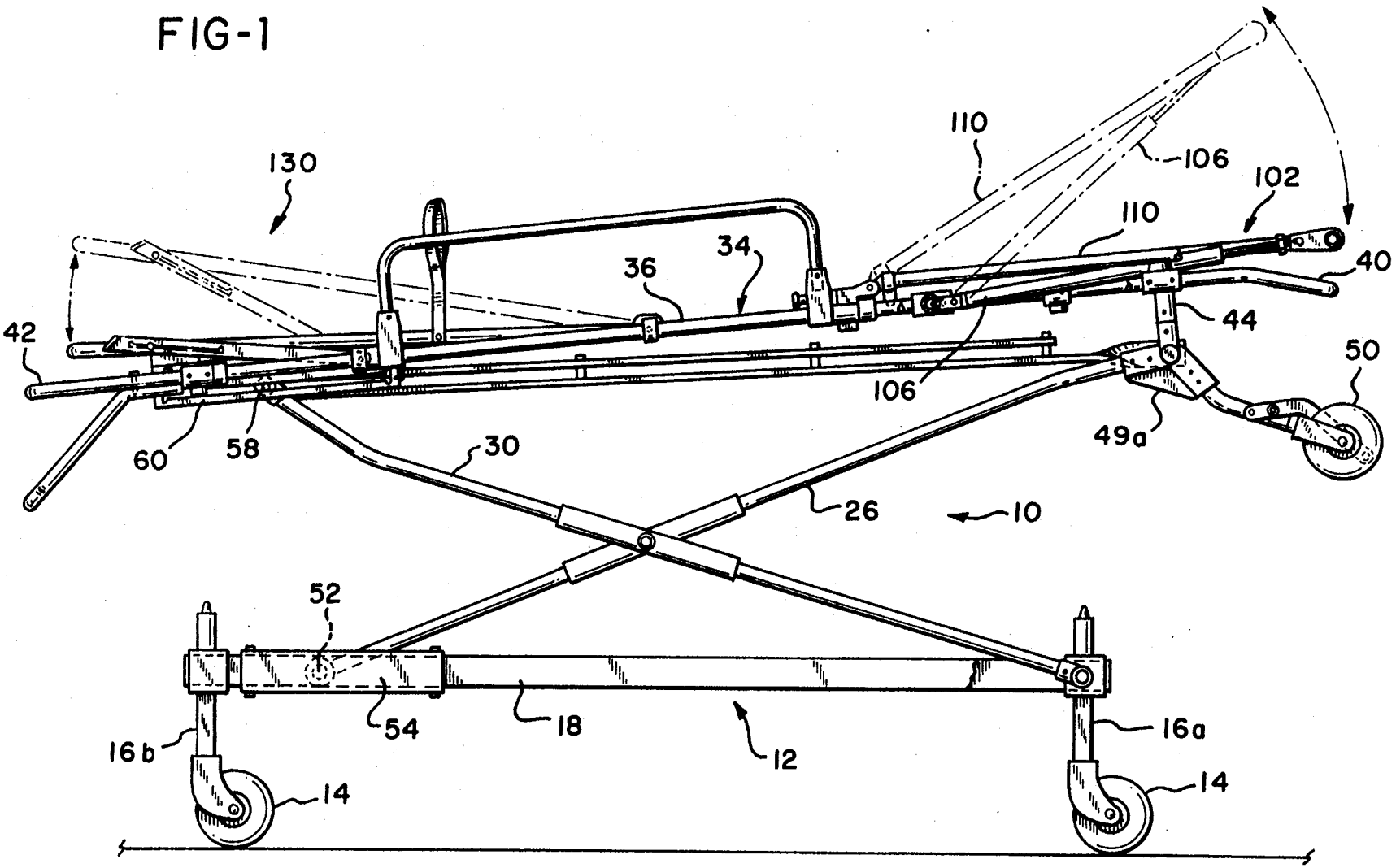
FIG. 1 is a side elevational view of the roll-in cot of the present invention with certain parts in broken lines for purposes of illustration.
Figure 2:
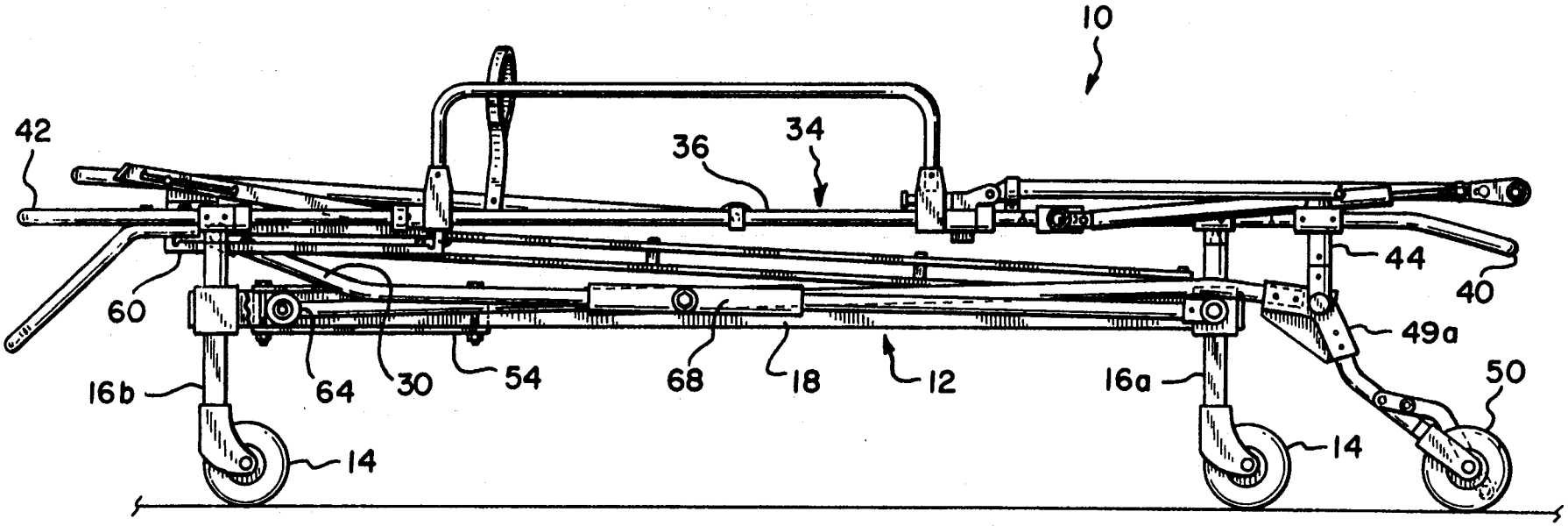
FIG. 2 is side elevational view of the roll-in cot of the present invention in a fully lowered configuration, with loading wheels on the ground.
Figure 9:
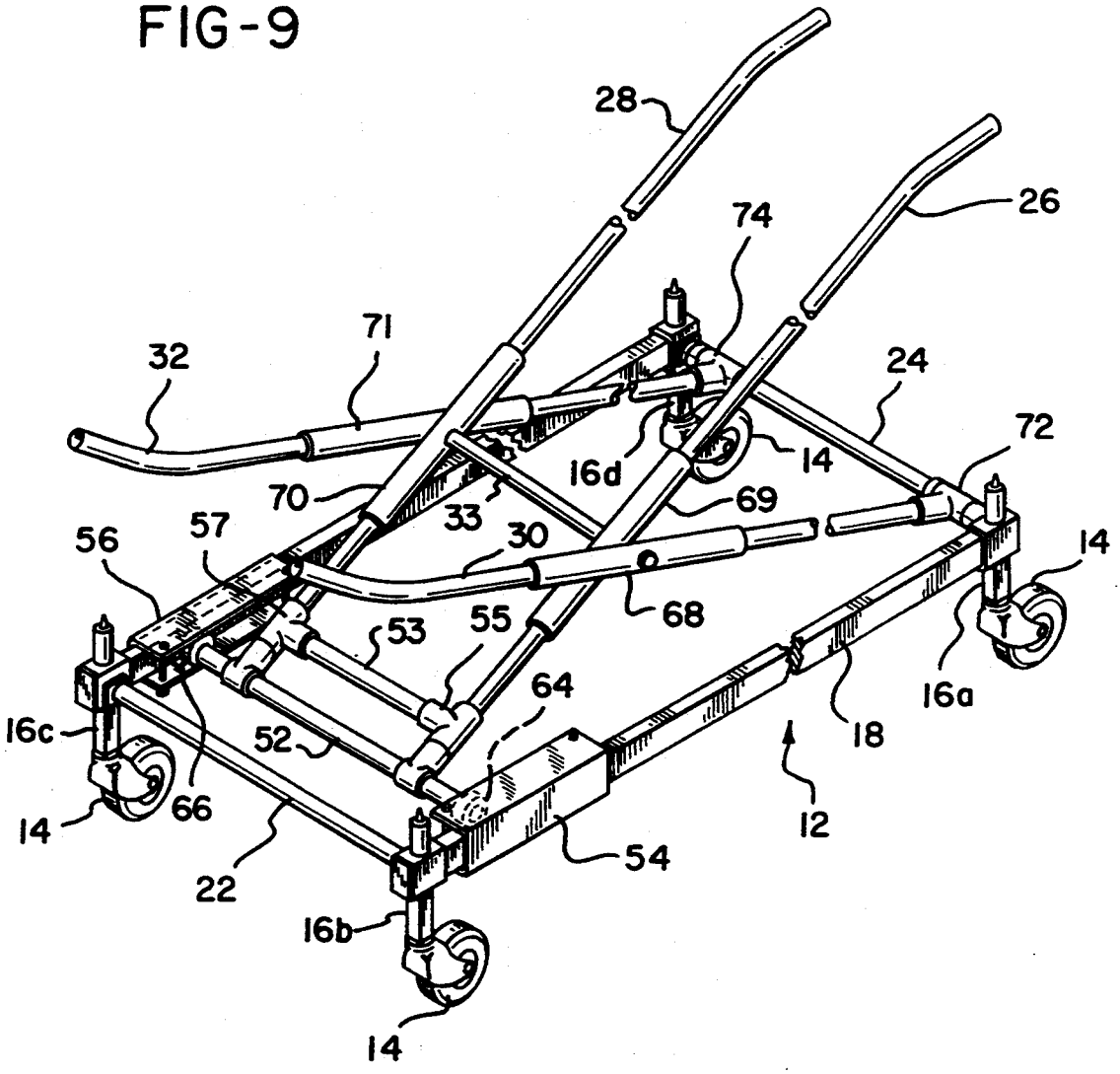
FIG. 9 is a perspective view of the undercarriage portion of the roll-in cot of the present invention with the complementary cross-forming frame members.

Referring first to FIGS. 1, 2, and 9, the roll-in cot 10 of the present invention is illustrated in both an elevated (FIG. 1) and fully down (FIG. 2) position. The cot 10 has a rectangular undercarriage 12 including a pair of opposing side frame members 18, 20 interconnected by a pair of transverse frame members 22, 24. For purposes of explanation, the undercarriage will be referred to as having a leading end and a trailing end, with the leading end being defined as the end toward the loading wheels 50 on the cot frame 34. Undercarriage 12 also includes downwardly extending supports **16*a*, 16*b*, 16*c*, and 16*d* affixed as shown at respective corners of the rectangular undercarriage. Undercarriage wheels 14** are attached to the downwardly extending supports in a conventional manner to provide high ground clearance for the undercarriage. This high clearance is particularly useful for ambulances having high wheel wells along their floors which the undercarriage of the cot must clear as it is rolled into the ambulance.

Figure 3:
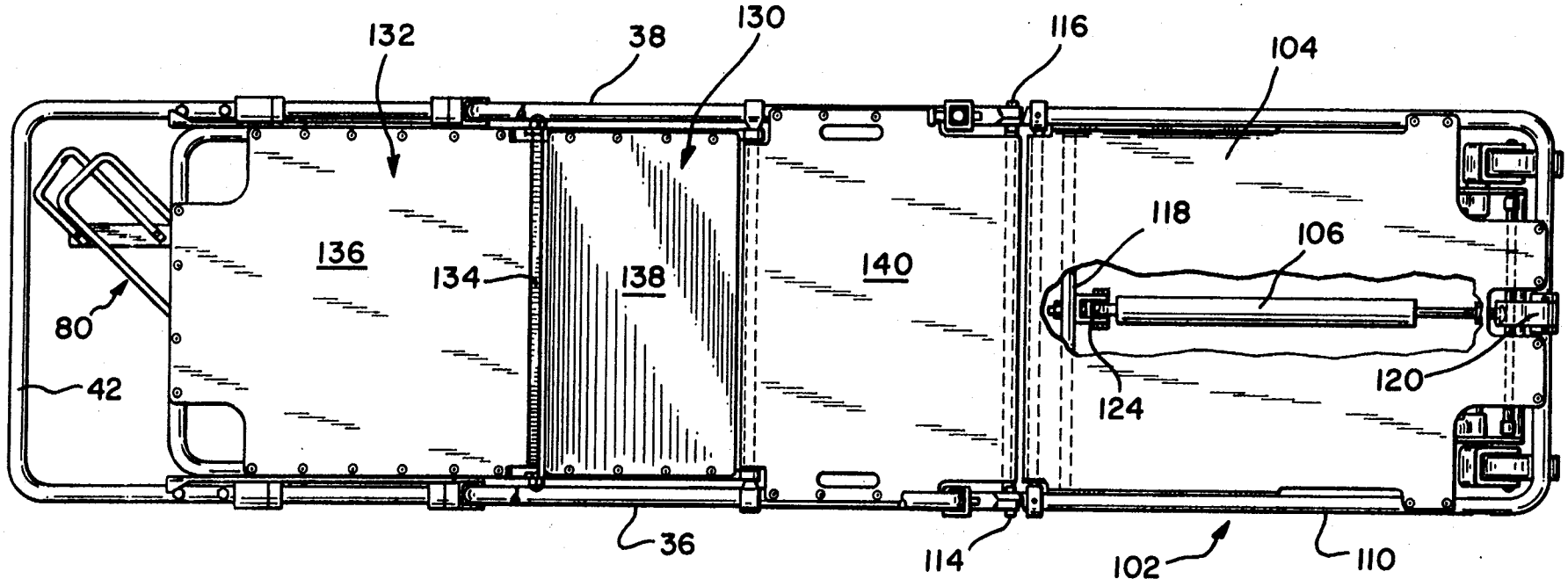
FIG. 3 is top plan view of the roll-in cot of FIG. 1, with certain parts broken away to show underlying parts.
Figure 4:
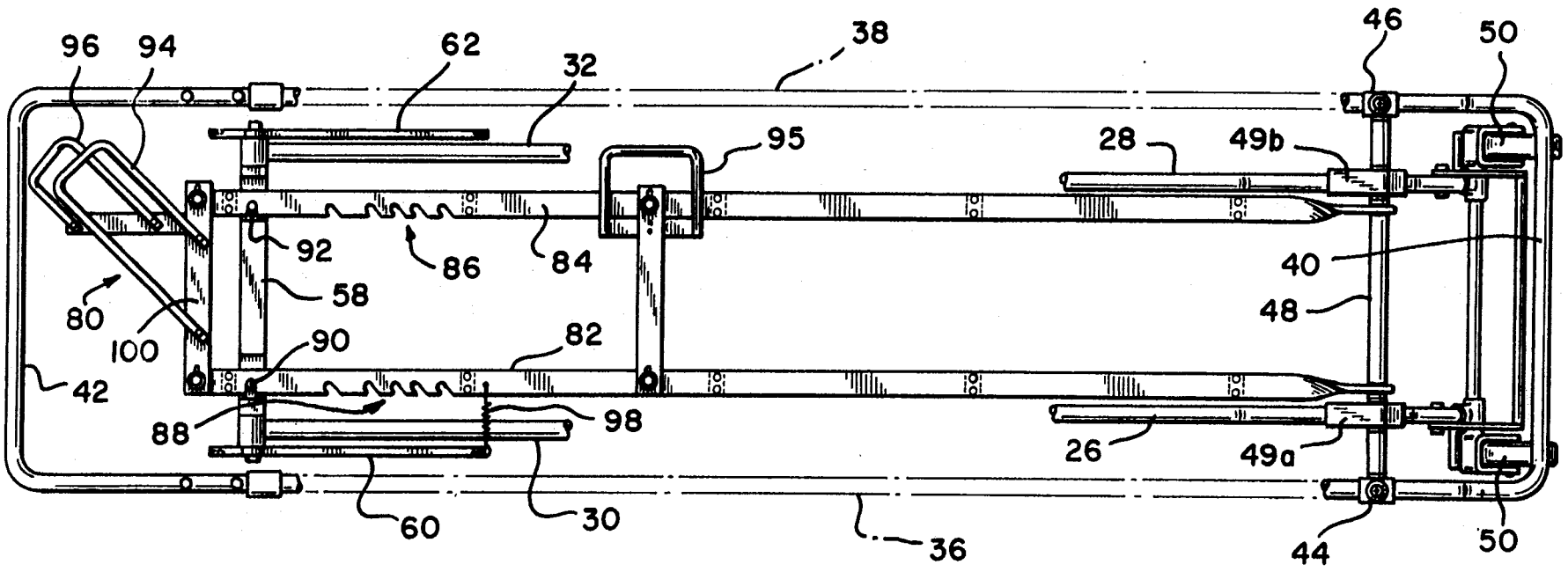
FIG. 4 is a top plan view of the latching mechanism of the roll-in cot, with certain parts removed for purposes of illustration.

Referring also now to FIGS. 3 and 4, the cot frame 34 also has a leading end and a trailing end, with the leading end again being defined as the end toward the load wheels 50. Cot frame 34 includes a pair of opposing tubular side frame members 36, 38 which are interconnected at their respective ends by tubular transverse frame members 40, 42, respectively. The leading end of cot frame 34 includes a pair of supports 44, 46 which extend downwardly from each of opposing side frame members 36, 38. The opposite ends of supports 44, 46 are secured to a transverse member 48 (also seen in FIGS. 4 and 5) which extends across and below the cot frame 34. A pair of load wheels 50 are secured to cot frame 34 through transverse member 48 by rotatable fittings **49*a* and 49*b***.

As best viewed in FIG. 9, extending upwardly from undercarriage 12 are coacting pairs of complementary first and second cross-forming frame members 26, 28, 30, 32 extending between and interconnecting cot frame 34 and the undercarriage 12. The frame members in each respective pair are pivotally connected together intermediate their opposite ends by a transverse bar 33 and associated fittings and sleeves 68, 69, 70, and 71. The frame members 26, 28, 30, and 32 are operative to position roll-in cot 10 in at least a first "down"]position and a second "up" position. The up position, in which the frame members and the cot frame are elevated, is shown in FIG. 1. In the down position, the frame members are fully collapsed as illustrated in FIG. 2. When in the fully collapsed position, undercarriage wheels 14 and the pair of load wheels 50 support the weight of roll-in cot 10. This permits the cot to be used for upright seating for several patients and passengers in an ambulance.

As shown, the first frame members of each pair 26, 28 are connected at their lowermost ends to opposite sides of a cross piece 52. Additional bracing and support is provided by a second cross piece 53 secured to frame members 26, 28 through fittings 55, 57. Opposing ends of cross piece 52 include rotatable rubber bearings 64, 66 which are slidably mounted in brackets 54, 56. Brackets 54, 56 are secured to opposing side frame members 18, 20 of undercarriage 12 adjacent the trailing end of undercarriage 12. The second frame members of each pair 30, 32 are rotatably connected at their lowermost ends to transverse frame member 24 on the leading end of undercarriage 12. As shown, the rotatable connections include T-shaped fittings 72, 74.

As best seen in FIGS. 1 and 4, the uppermost ends of first frame members 26, 28 are rotatably connected to transverse frame member 48 on cot frame 34 adjacent the leading end thereof. The uppermost ends of the second frame members 30, 32 are rotatably connected to a transverse support member 58. Transverse support member 58 is slidably mounted in a pair of opposing brackets 60, 62 secured to cot frame 34.

Figure 5:
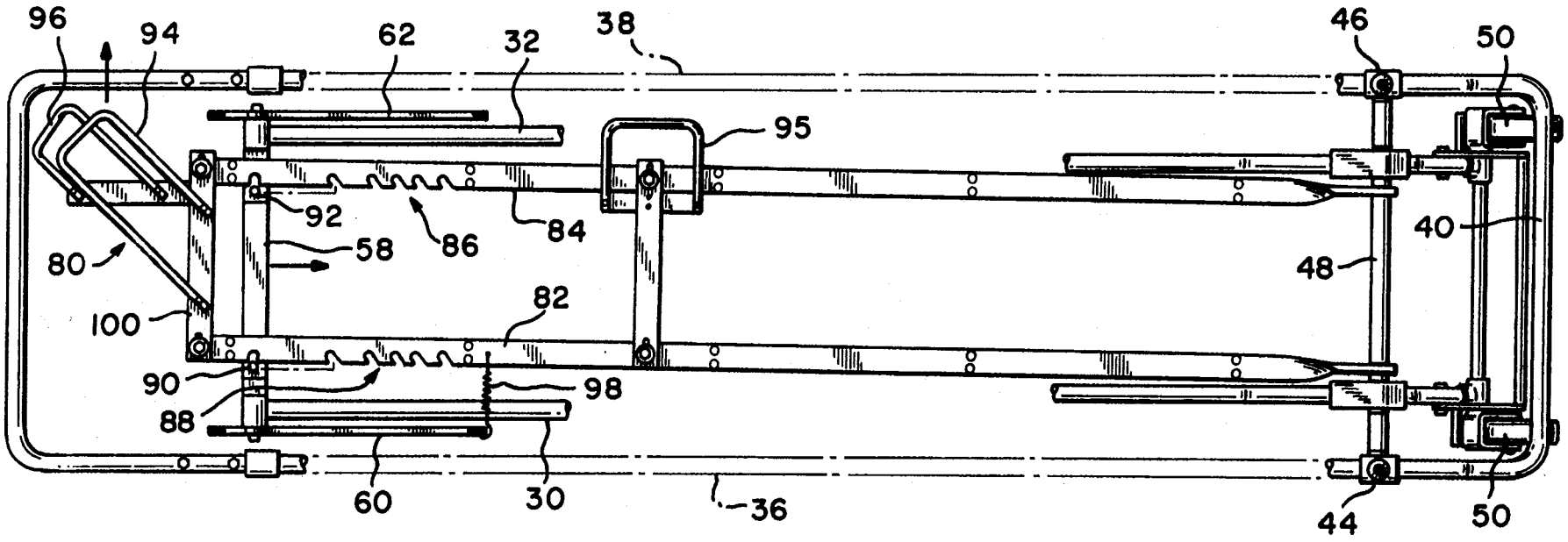
FIG. 5 is a top plan view of the latching mechanism of the roll-in cot showing the manner of releasing the mechanism, with certain parts removed for purposes of illustration.

Referring now to FIGS. 4 and 5, roll-in cot 10 includes means for latching the pairs of frame members 26, 28, 30, and 32 in said at least two, and preferably several positions ranging from a first down, fully collapsed position to a fully elevated position. The latching means are generally indicated at 80 and comprise a pair of latching bars 82, 84 secured together by cross piece 100. Each of the latching bars are secured at respective first ends thereof to transverse member 48 on cot frame 34 and at respective second ends thereof to cross piece 100. Each of the latching bars 82, 84 includes a plurality of spaced apart slots, generally indicated at 86, 88. The slots are angled and adapted to engage a corresponding pair of load-bearing pins 90, 92 located on transverse support member 58.

As shown, pin engaging means, such as handles 94 and 96, are operatively connected to the latching bars by a cross piece 100. These handles may be manipulated by the emergency medical technician standing at the end of the cot by pulling them in the direction indicated by the arrow in FIG. 5 to disengage pins 90, 92 from individual slots. An additional handle 95 is provided on latching bar 84 so that the latching mechanism may also be operated from one side of cot 10.

Spring 98 biases latching bars 82, 84 to force slots 86, 88 to engage with pins 90, 92. The technician may select the position in which cot 10 is placed, from fully down to fully elevated by sliding the latching mechanism in the direction of the arrow in FIG. 5 and then releasing the handle(s) to reengage the slots with pins 90, 92. As slots 86, 88 are angled to seat with pins 90, 92, and transverse support member 58 is load bearing, the latching mechanism provides a positive lock of cot 10 into a desired position.

Figure 6:
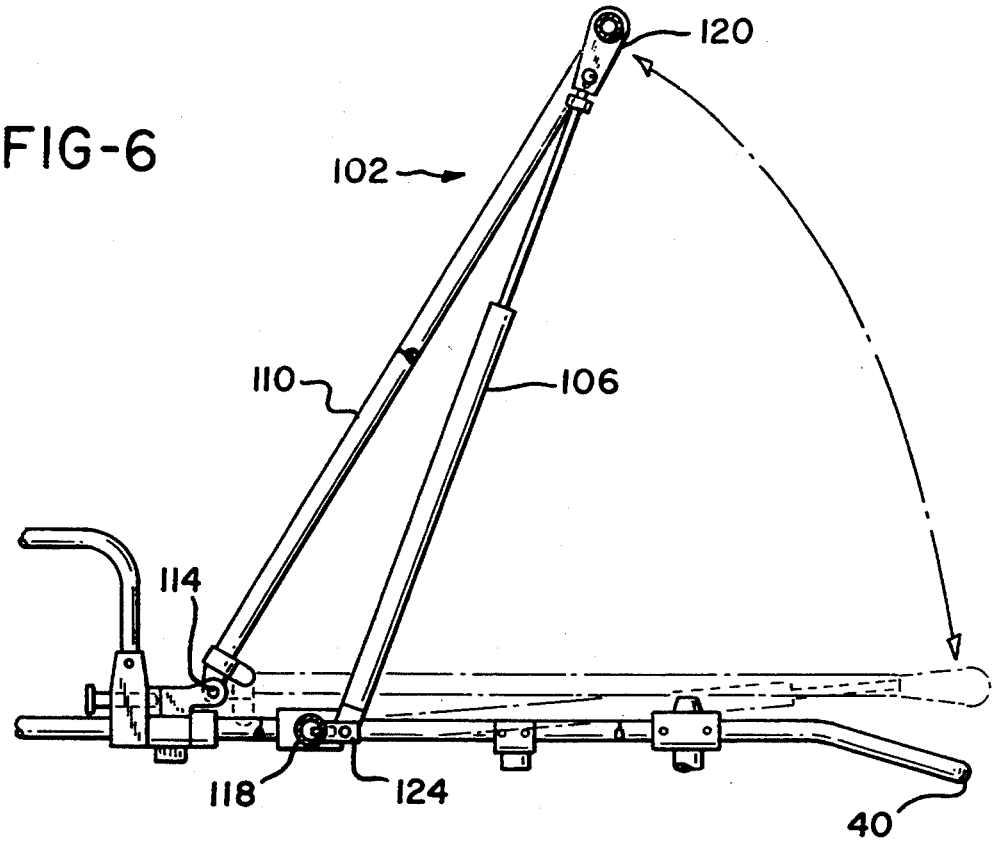
FIG. 6 is a partial side plan view illustrating the back support mechanism of the present invention.
Figure 7:
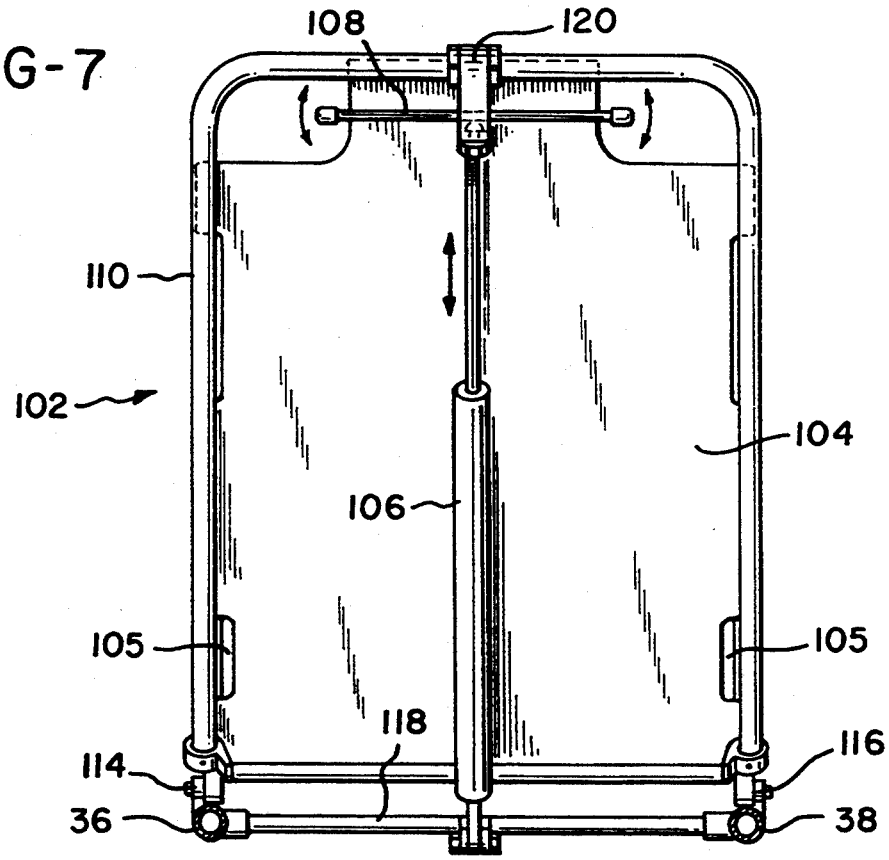
FIG. 7 is a partial end view illustrating the back support mechanism of the present invention.

Cot frame 34 also includes longitudinally extending foot, seat, and back support sections which may be positioned to provide support and comfort to a patient during transport. Referring now to FIGS. 1, 3, 6, and 7, back support section 102 includes a flat support plate 104 which is secured to continuous tubular member 110 by suitable means such as rivets or screws. Plate 104 includes several cut-out areas, such as those indicated at 105, to permit hand holds to be obtained on continuous tubular member 110 as needed. Back support section 102 also includes a gas-assisted cylinder 106 for raising the back support section from a first substantially horizontal position as shown in FIGS. 1 and 6 to a plurality of raised positions, such as the raised positions shown in FIG. 6 and in dotted lines in FIG. 1. Manipulation of bar 108 by the emergency technician in any of the directions shown by the arrows in FIG. 7 causes a raising or lowering of the back support as desired. That is, depressing or raising either end of bar 108 by a technician depresses a detent on cylinder 106 which releases a locking mechanism internally in the cylinder and permits movement of back support section 102. When bar 108 is released, it moves back to a centered, at rest, position permitting the detent on cylinder 106 to raise and locking back support section 102 in place.

As shown, back support section 102 is pivotally connected to the side frame members 36, 38 of cot frame 34 by bifurcated hinges 114 and 116. The hinges are of a conventional construction in which a bifurcated part receives a tongue part, the parts being connected together by a pivot pin. The hinges 114 and 116 are oriented to permit back rest section 102 to be moved from and to the positions indicated in the drawing figures. Also as shown, cylinder 106 is rotatably secured to a transverse member 118 on cot frame 34 via hinge 124. At its opposite end, cylinder 106 is secured to continuous tubular member 110 via a hinged mounting 120 which swivels to accommodate the rasing and lowering of back support section 102.

Figure 8:
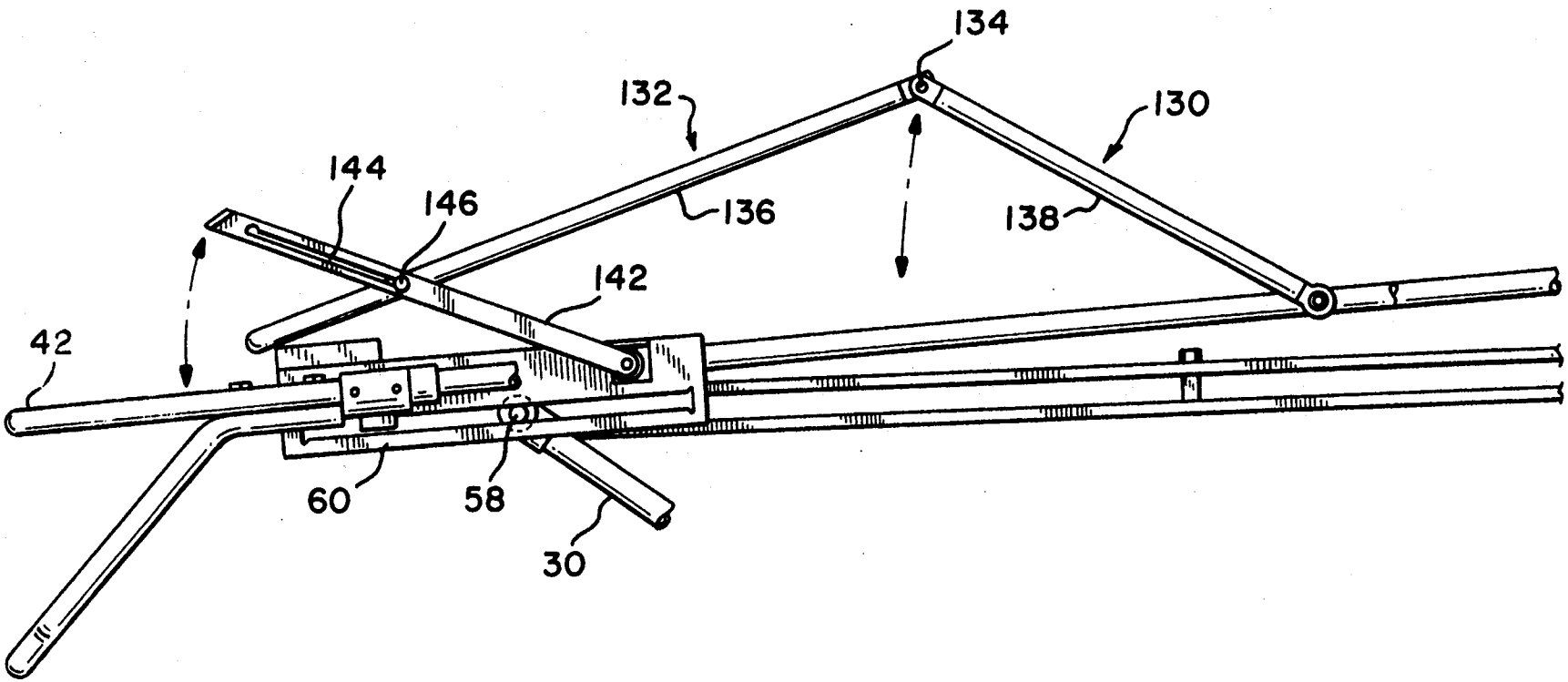
FIG. 8 is a partial side plan view illustrating the adjustable dual position foot support mechanism of the present invention.

Referring principally now to FIGS. 1, 3 and 8, roll-in cot 10 also includes a dual position adjustable foot support section 130. Foot support section 130 includes first and second portions 130 and 132, respectively, which are pivotally connected along hinge 134. Those portions include flat plates 136, 138 for supporting a patient's legs. Together with seat plate 140, a complete patient support structure is provided.

As shown, pivotally mounted arms 142 (corresponding structure on opposite side of cot not shown) having guide slots 144 which receives a pin 146 is movable to two different positions as desired. The guide slots include enlarged openings at both ends of the slots which latch the pins in place. In a first elevated position, shown in dotted lines in FIG. 1, pin 146 is locked in the end of guide slot 144 closest to the trailing end of cot 10. This causes both portions 136 and 138 to be raised to lift a patient's legs to a "shock" position as is known in the art. Additionally, pin 146 may be caused to travel along the length of guide slot 144 to a position at the opposite end of the slot. Lifting of arm 142 when the pin is locked in this position causes the first and second portions 136 and 138 to form an inverted-V position which supports a patient's knees and legs in a bent position.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A roll-in cot comprising:

a rectangular undercarriage including a pair of side frame members and a pair of transverse frame members, said undercarriage having a leading end and a trailing end, downwardly extending supports affixed at respective corners of said rectangular undercarriage, undercarriage wheels attached to said downwardly extending supports to provide high ground clearance for said undercarriage;

a cot frame having a pair of opposing side frame members and a pair of transverse frame members, said cot frame having a leading and a trailing end, said leading end including a pair of supports which extend downwardly from each of said opposing side frame members intermediate said transverse frame members and are secured to a transverse member at opposite ends thereof from said side frame members, and a pair of load wheels secured to said cot frame through said transverse member; and coacting pairs of complementary first and second cross-forming frame members extending between and interconnecting said cot frame and said undercarriage, said frame members in each pair being pivotally connected together intermediate their opposite ends and operative to position said roll-in cot in at least a first down position in which said frame members are fully collapsed and said undercarriage wheels and said pair of load wheels support the weight of said roll-in cot and a second up position in which said frame members and said cot frame are elevated.

2. The roll-in cot of claim 1 in which the first frame members of each pair are connected at their lowermost ends to opposite sides of a cross piece, opposing ends of said cross piece being slidably mounted in brackets (54,56) secured to opposing side frame members of said undercarriage adjacent the trailing end of said undercarriage.

3. The roll-in cot of claim 1 in which the second frame members of each pair are rotatably connected at their lowermost ends to one of the transverse frame members which is at said leading end of said undercarriage.

4. The roll-in cot of claim 1 in which the uppermost ends of said first frame members are rotatably connected to said transverse member on said cot frame adjacent said leading end thereof.

5. The roll-in cot of claim 1 in which the uppermost ends of said second frame members are rotatably connected to a transverse support member, said transverse support member being slidably mounted in a pair of opposing brackets secured to said cot frame.

6. The roll-in cot of claim 1 in which said cot frame includes longitudinally extending foot, seat, and back support sections.

7. The roll-in cot of claim 6 in which said back support section includes a gas-assisted cylinder for raising said back support section from a first substantially horizontal position to a plurality of raised positions.

8. The roll-in cot of claim 7 in which said back support section includes a tubular frame and support plate, one end of said cylinder secured to said tubular frame via a swivel mounting and the opposite end of said cylinder hingedly mounted on said cot frame.

9. The roll-in cot of claim 7 including means for locking said gas-assisted cylinder in position.

10. The roll-in cot of claim 9 including means for releasing said locking means for said cylinder, said releasing means including a movable bar which cooperates which a depressible detent, whereby movement of said bar depresses said detent and releases said locking means.

11. The roll-in cot of claim 6 in which said foot support section includes first and second portions which are pivotally connected.

12. The roll-in cot of claim 11 in which said foot support section includes a latch member operative to raise said first and second portions to an elevated position or to slide said first portion relative to said second portion to form an inverted-V position.

13. The roll-in cot comprising:

a rectangular undercarriage including a pair of side frame members and a pair of transverse frame members, said undercarriage having a leading end and a trailing end, downwardly extending supports affixed at respective corners of said rectangular undercarriage, undercarriage wheels attached to said downwardly extending supports to provide high ground clearance for said undercarriage;

a cot frame having a leading end, a trailing end, and a pair of opposing side frame members, said leading end including a pair of supports which extend downwardly from each of said opposing side frame members and are secured to a transverse member, and a pair of load wheels secured to said cot frame through said transverse member; and coacting pairs of complementary first and second cross-forming frame members extending between and interconnecting said cot frame and said undercarriage, said frame members in each pair being pivotally connected together intermediate their opposite ends and operative to position said roll-in cot in at least a first down position in which said frame members are fully collapsed and said undercarriage wheels and said pair of load wheels support the weight of said roll-in cot and a second up position in which said frame members and said cot frame are elevated, and further including means for latching said frame members in said at least first down and second up positions, said latching means comprising a pair of latching bars, each of said latching bars secured at respective first ends thereof to said transverse member on said cot frame and at respective second ends thereof to a transverse support member, each of said latching bars including a plurality of spaced apart slots therein, said slots adapted to engage a corresponding pair of load-bearing pins located on said transverse support member.

14. The roll-in cot of claim 13 including pin engaging means operatively connected to said cross piece connecting said latching bars for engaging said pins in selected slots on said latching bars.

15. The roll-in cot of claim 14 in which said pin engaging means is spring biased to force said pins into said slots.

16. A roll-in cot comprising:

a rectangular undercarriage including a pair of side frame members and a pair of transverse frame members, said undercarriage having a leading end and a trailing end, undercarriage wheels attached to said undercarriage;

a cot frame having a pair of opposing side frame members and a pair of transverse frame members, said cot frame having a leading and a trailing end, said leading end including a pair of supports which extend downwardly from each of said opposing side frame members intermediate said transverse frame members and are secured to a transverse member at opposite ends thereof from said side frame members, and a pair of load wheels secured to said cot frame through said transverse member;

coacting pairs of complementary cross-forming frame members extending between and interconnecting said cot frame and said undercarriage, said frame members in each pair being pivotally connected together intermediate their opposite ends; and means for latching said frame members in at least a first down position in which said frame members are fully collapsed and said undercarriage wheels and said pair of load wheels support the weight of said roll-in cot and a second up position in which said frame members and said cot frame are elevated.

17. The roll-in cot of claim 16 in which said latching means comprise a pair of latching bars, each of said latching bars secured at respective first ends thereof to said transverse member on said cot frame and at respective second ends thereof to a transverse support member, each of said latching bars including a plurality of spaced apart slots therein, said slots adapted to engage a corresponding pair of load-bearing pins located on said transverse support member.

18. A roll-in cot comprising:

a rectangular undercarriage including a pair of side frame members and a pair of transverse frame members, said undercarriage having a leading end and a trailing end, undercarriage wheels attached to said undercarriage;

a cot frame having a pair of opposing side frame members and a pair of transverse frame members, said cot frame having a leading and a trailing end, said leading end including a pair of supports which extend downwardly from each of said opposing side frame members intermediate said transverse frame members and are secured to a transverse member at opposite ends thereof from said side frame members, and a pair of load wheels secured to said cot frame through said transverse member; said cot frame including longitudinally extending foot, seat, and back support sections, said back support section including a gas-assisted cylinder for raising said back support section from a first substantially horizontal position to a plurality of raised positions; and coacting pairs of complementary cross-forming frame members extending between and interconnecting said cot frame and said undercarriage, said frame members in each pair being pivotally connected together intermediate their opposite ends and operative to position said roll-in cot in at least a first down position in which said frame members are fully collapsed and said undercarriage wheels and said pair of load wheels support the weight of said roll-in cot and a second up position in which said frame members and said cot frame are elevated.

19. The roll-in cot of claim 18 including means for locking said gas-assisted cylinder in position and means for releasing said locking means for said cylinder, said releasing means includes a movable bar which cooperates with a depressible detent, whereby movement of said bar depresses said detent and releases said locking means.

* * * * *